United States Patent [19]

Lester

[11] Patent Number: 5,024,206

[45] Date of Patent: Jun. 18, 1991

[54] COMPOUND ARCHERY BOW

[76] Inventor: Wayne L. Lester, 3935 Willow Run, Flower Mound, Tex. 75028

[21] Appl. No.: 285,652

[22] Filed: Dec. 16, 1988

[51] Int. Cl.[5] ..... F41B 5/00

[52] U.S. Cl. ..... 124/23.1; 124/88; 124/900

[58] Field of Search ..... 124/24 R, 23 R, DIG. 1, 124/86, 88

[56] References Cited

U.S. PATENT DOCUMENTS

| | | | |
|---|---|---|---|
| 3,987,777 | 10/1976 | Darlington | 124/23 R |
| 4,064,862 | 12/1977 | Groner | 124/23 R |
| 4,183,345 | 1/1980 | Caldwell | 124/24 R |
| 4,207,859 | 6/1980 | Scholten | 124/24 R |
| 4,287,867 | 9/1981 | Islas | 124/DIG. 1 X |
| 4,338,910 | 7/1982 | Darlington | 124/24 R |
| 4,515,142 | 5/1985 | Nurney | 124/DIG. 1 X |
| 4,686,955 | 8/1987 | Larson | 124/DIG. 1 X |
| 4,748,962 | 6/1988 | Larson | 124/DIG. 1 X |
| 4,756,296 | 7/1988 | Darlington | 124/DIG. 1 X |

*Primary Examiner*—Peter M. Cuomo
*Attorney, Agent, or Firm*—Timmons & Kelly

[57] ABSTRACT

A compound bow having a handle, upper and lower limbs, and a bowstring. Upper and lower pulleys are mounted on the bow. Each pulley has a helical groove of three turns, one turn having a different diameter from the other two. Tension cables travel around two of the three turns of the pulleys. As the bowstring is drawn, the pulleys rotate 360 degrees, and the cables unwind from one turn and wind onto a different turn.

8 Claims, 4 Drawing Sheets

COMPOUND ARCHERY BOW

BACKGROUND OF THE INVENTION

1. Field of the Invention

This invention relates in general to archery bows. More particularly, the invention relates to improved compound archery bows.

2. Description of the Prior Art

Prior art compound bows have tension cables that cooperate with eccentric pulleys or levers to change the mechanical advantage of the bow as the bowstring is drawn and as the bowstring returns after being released. The archer is thus able to hold the bowstring in the fully drawn position with less force. As a result, it is easier to hold the bow steady and to aim.

The pulleys, however, add a significant mass to the ends of the bow. The mass of the pulleys tends to retard the movement of the limbs after an arrow is released. Reducing the weight and the diameter of the pulleys would therefore increase the efficiency of the bow. Reducing the diameter of the pulleys also reduces limb torque or twisting.

It is necessary to insure that the tension cables do not interfere with the bowstring of the arrow. The cables must be offset from the plane of the bowstring in some manner, or cable guards must deflect the cables. Cable guards put a side loading on the arrow and the friction on the cables reduces the efficiency of the bow.

In prior art compound bows the tension cables usually do not travel completely around the pulleys. As a result, the pulleys only rotate through approximately 250 degrees as the bowstring moves between its undrawn position and its fully drawn position.

SUMMARY OF THE INVENTION

The compound bow assembly of the invention includes a bow that has upper and lower limbs connected to a handle. A bowstring is strung between the tips of the limbs and is movable between an undrawn position and a fully drawn position.

An upper pulley and a lower pulley are mounted on the bow, either on the handle or on the limbs. The pulleys have helical grooves of at least two turns, and the diameter of each of the turns can be different from the diameters of the other turns.

An upper tension cable is connected to the upper limb and travels around the lower pulley. Likewise, a lower tension cable is connected to the lower limb and travels around the upper pulley. As the bowstring is drawn, the tension cables cause the pulleys to rotate 360 degrees.

In one embodiment of the invention, the pulleys are mounted on the handle. The upper tension cable extends from the upper limb, around the lower pulley, and is then attached to the upper end of the lower limb. The lower tension cable extends from the lower limb, around the upper pulley, and is then attached to the lower end of the upper limb.

In a second embodiment of the invention, the pulleys are mounted on the tips of the limbs. The upper tension cable extends from the upper limb, around the lower pulley, and then is attached to the lower end of the bowstring. The lower tension cable extends from the lower limb, around the upper pulley, and then is attached to the upper end of the bowstring.

DESCRIPTION OF THE PREFERRED EMBODIMENT

Figure 1:
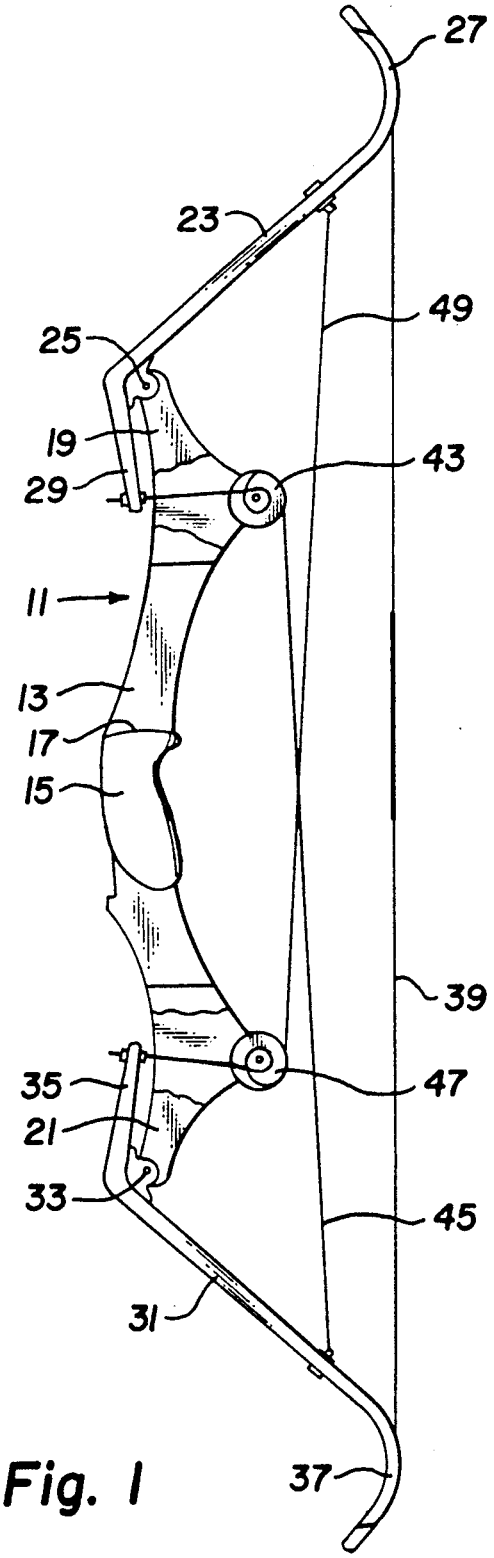
FIG. 1 is a side view, partially broken away, of the preferred embodiment of the invention, in the undrawn position.
Figure 2:
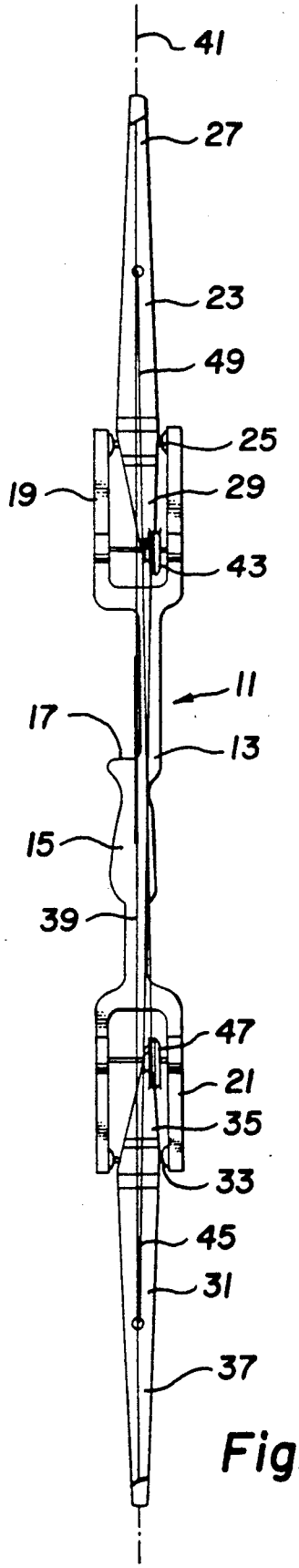
FIG. 2 is a rear view of the apparatus of FIG. 1.
Figure 3:
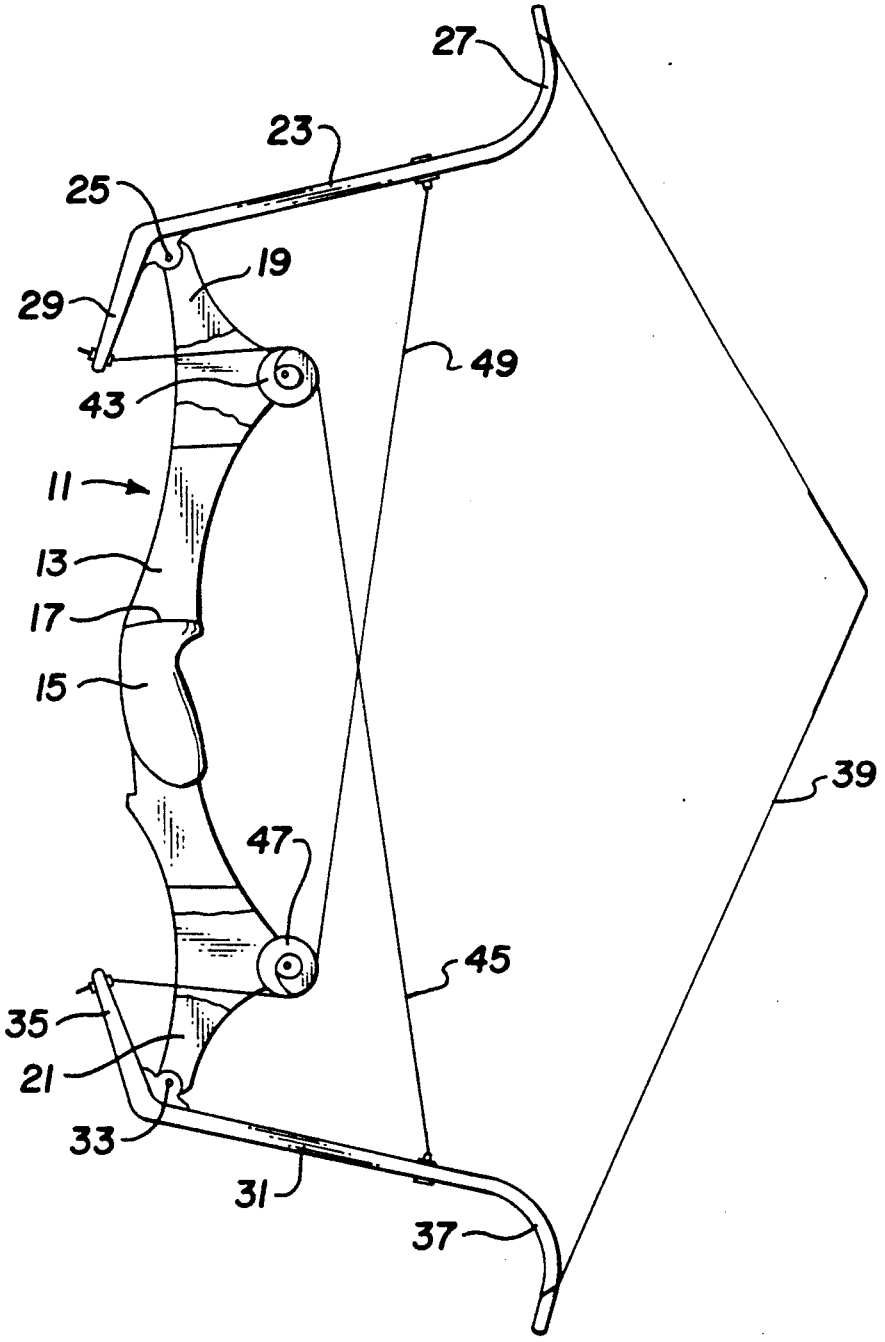
FIG. 3 is a side view of the apparatus of FIG. 1, in the fully drawn, position

As shown in FIGS. 1–3, the preferred embodiment of the invention is a compound archery bow 11 having a handle 13. The handle 13 includes a hand grip 15 and an arrow rest 17. The upper end 19 and the lower end 21 of the handle are forked, as is most clearly seen in FIG. 2.

An upper limb 23 is mounted in the fork of the upper end 19 of the handle 13 at a pivot point 25. The upper limb 23 has an upper end 27 and a lower end 29, the upper end 27 being recurved, as shown. A lower limb 31 is mounted in the fork of the lower end 21 of the handle 13 at a pivot point 33. The lower limb 31 has an upper end 35 and a lower end 37, the lower end 37 being recurved, as shown.

A bowstring 39 is strung between the upper tip 27 of the upper limb 23 and the lower tip 37 of the lower limb 31. The bowstring 39 can be drawn between an undrawn position, shown in FIG. 1, and a fully drawn position, shown in FIG. 3. As the bowstring 39 is drawn, the limbs 23 and 31 pivot about the pivot points 25 and 33. The bowstring 39 travels through a plane 41 defined by the bowstring 39 itself and the arrow rest 17, as shown in FIG. 2.

An upper pulley 43 is mounted on the handle 13. A lower tension cable 45 extends from the lower limb 31 to the upper pulley 43. The cable 45 travels around the pulley 43 and is then attached to the lower end 29 of the upper limb 23.

A lower pulley 47, similar to the upper pulley 43, is also mounted on the handle 13. An upper tension cable 49 extends from the upper limb 23 to the lower pulley 47. The cable 49 travels around the pulley 47 and is then attached to the upper end 35 of the lower limb 31. As shown in FIG. 2, the tension cables 45 and 49 are offset from the plane 41 of the bowstring 39.

Figure 4:
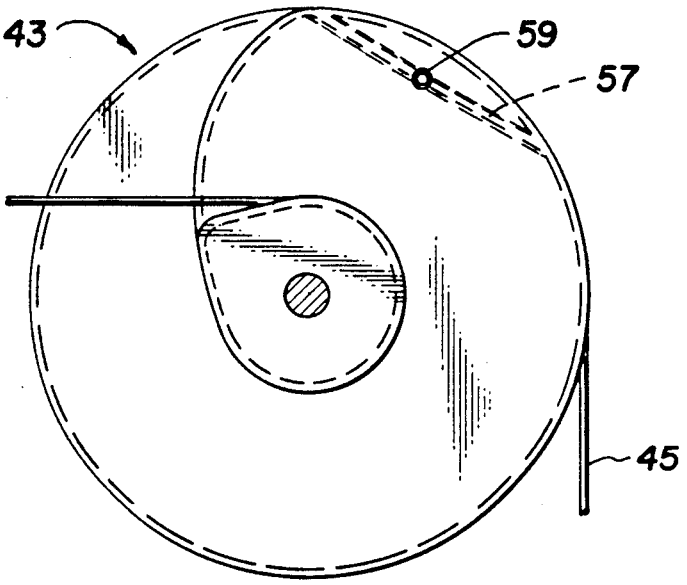
FIG. 4 is a side view of the upper pulley of the apparatus of FIG. 1.
Figure 5:
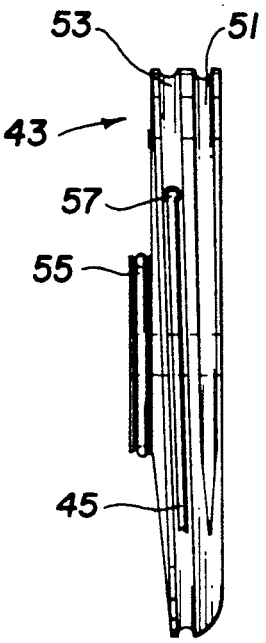
FIG. 5 is a rear view of the upper pulley of the apparatus of FIG. 1.

FIGS. 4 and 5 show the upper pulley 43 in greater detail. The lower pulley 47 is similar to the upper pulley 43 in design and operation. The upper pulley 43 is generally circular and has a helical groove that makes three turns around the pulley 43. The first turn 51 and the second turn 53 have approximately the same diameter. The third turn 7 has a much smaller diameter.

During the second turn 53, the tension cable 45 passes through a hole 57 in the pulley 43. A set screw 59 intercepts the cable 45 in the hole 57 to lock the cable 45 to the pulley 43. Movement of the tension cable 45 thus causes the pulley 43 to rotate.

When the bowstring 39 is in the relaxed, undrawn position, as shown in FIGS. 4 and 5, the tension cable 45 is not located in the first turn 51 of the pulley 43. The cable 45 enters the pulley 43 at the second turn 53 and passes through the hole 57 in the pulley 43. The cable 45 then travels around the third turn 55 and extends to the lower end 29 of the upper limb 23.

When the bowstring 39 is drawn, the lower end 29 of the upper limb 23 pulls on the tension cable 45, causing the pulley 43 to rotate in a counterclockwise direction as seen in FIGS. 1, 2, and 4. The cable 45 unwinds from the smaller third turn 55 and winds around the larger first turn 51. As the bowstring 39 moves from the undrawn position to the fully drawn position, the pulley 43 rotates a full 360 degrees.

In the fully drawn position, the cable 45 is no longer located in the third turn 55 of the pulley 43. The cable 45 exits the hole 57 in the pulley 43 and extends directly to the lower end 29 of the upper limb 23.

The lower pulley 47 is similar to the upper pulley 43 in design and operation. The lower pulley 47 is a mirror image of the upper pulley 43. As the bowstring 39 is drawn, the lower pulley 47 rotates in a clockwise direction as viewed in FIGS. 1 and 2.

As seen clearly in FIG. 2, the tension cables 45 and 49 are offset from the plane 41 of the bowstring 39. This prevents the cables 45 and 49 from contacting the arrow. If the cables 45 and 49 contacted the arrow, the cables 45 and 49 would place an unwanted side force on the arrow and the arrow would put a frictional force on the cables 45 and 49.

Figures 6, 7, 8:
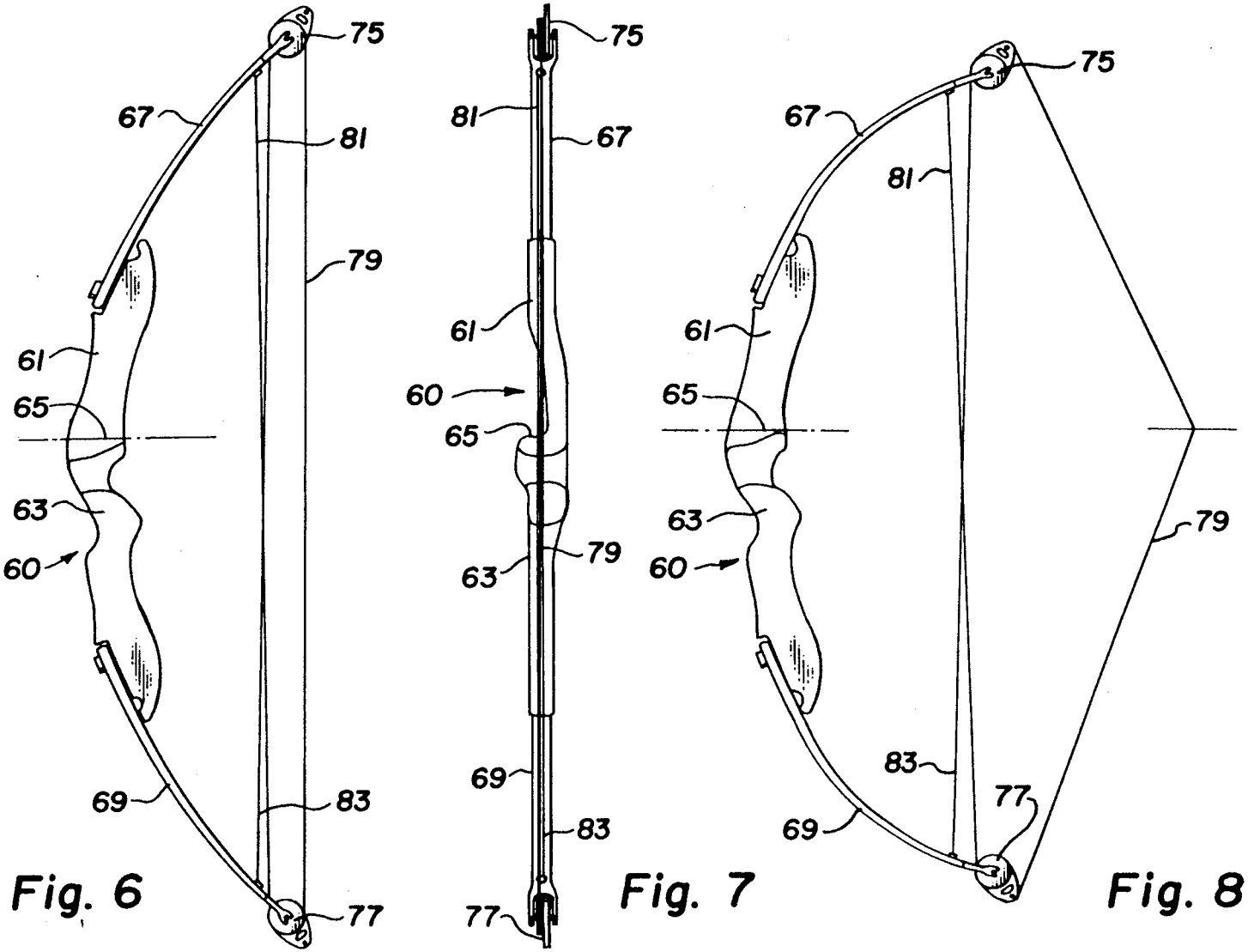
FIG. 6 is a side view of a second embodiment of the invention, in the undrawn position.
FIG. 7 a rear view of the apparatus of FIG. 6.
FIG. 8 is a side view of the apparatus of FIG. 6, in the fully drawn position.

FIGS. 6–8 illustrate a second embodiment of the invention. The second embodiment is a compound archery bow 60 having a handle 61 that includes a hand grip 63 and an arrow rest 65. The bow 60 also includes an upper limb 67 and a lower limb 69, connected to the handle 61 at an upper pivot point 71 and a lower pivot point 73, respectively.

Similar to the first embodiment, the bow 60 has an upper pulley 75 and a lower pulley 77. However, rather than being mounted on the handle 61, the upper pulley 75 is mounted on the upper limb 67 and the lower pulley 77 is mounted on the lower limb 69.

A bowstring 79 is strung between the upper pulley 75 and the lower pulley 77. The bowstring 79 can be drawn between an undrawn position, shown in FIG. 6, and a fully drawn position, shown in FIG. 8.

An upper tension cable 81 extends from the upper limb 67 to the lower pulley 77. The upper tension cable 81 travels around the lower pulley 77 and is attached to the lower end of the bowstring 79. Likewise, a lower tension cable 83 extends from the lower limb 69 to the upper pulley 75. The lower tension cable 83 travels around the upper pulley 75 and is attached to the upper end of the bowstring 79.

Figure 9:
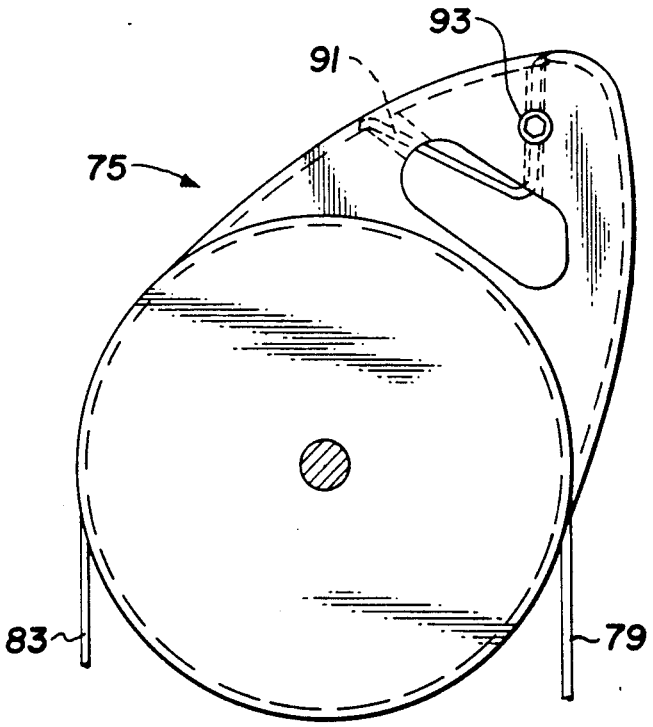
FIG. 9 is a side view of the upper pulley of the apparatus of FIG. 6.
Figure 10:
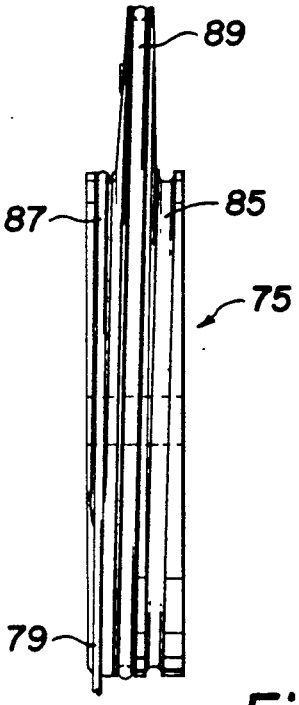
FIG. 10 is a rear view of the upper pulley of the apparatus of FIG. 6.

FIGS. 9 and 10 illustrate the upper pulley 75 in greater detail. The lower pulley 77 is similar in design and operation. The upper pulley 75 is generally circular and has a helical groove that makes three turns around the pulley 75. The first turn 85 and the third turn 87 have approximately the same diameter. The second turn 89 has a much larger diameter. Actually, the second turn 89 is not circular, but is elliptical. Therefore, the larger "diameter" is in this case defined as the long axis of the ellipse.

During the second turn 89, the tension cable 83 passes through a hole 91 in the pulley 75. A set screw 93 intercepts the cable 83 in the hole 91 to lock the cable 83 to the pulley 75. Movement of the tension cable 83 thus causes the pulley 75 to rotate.

When the bowstring 79 is in the relaxed, undrawn position, as shown in FIGS. 9 and 10, the tension cable 83 is not located in the first turn 85 of the pulley 75. The cable 83 enters the pulley 75 at the second turn 89 and passes through the hole 91 in the pulley 75. The cable then wraps around the third turn 87 and attaches to the bowstring 79.

When the bowstring 79 is drawn, the pulley 75 rotates in a clockwise direction as seen in FIG. 6, 7 and 9. The cable 83 unwinds from the third turn 87 and winds around the first turn 85. As the bowstring 79 moves from the undrawn position to the fully drawn position, the pulley 75 rotates a full 360 degrees.

In the fully drawn position the cable 83 is no longer located in the third turn 87 of the pulley 75. The cable 83 travels around the first turn 85 and the second turn 89, passes through the hole 91 in the pulley 75, and attaches to the bowstring 79.

The lower pulley 77 is similar to the upper pulley 75 in design and operation. The lower pulley 77 is a mirror image of the upper pulley 77 rotates in a counterclockwise direction as viewed in FIGS. 6 and 7.

The apparatus of the invention has several advantages over the prior art. The bows of the invention have an increased efficiency because the pulleys rotate an entire 360 degrees. The pulleys of the invention have a smaller diameter than pulleys in prior art bows. Further, the bows of the invention store a greater amount of energy. Due to the 360 degree rotation of the pulleys, the force-draw curve of the bow can be tailored to a greater degree.

Only two embodiments of the invention have been described. Various changes and modifications may be made without departing from the spirit or scope of the invention as described by the claims.

I claim:

1. A compound archery bow assembly, comprising:

a handle having an upper end and a lower end;

an upper limb having an upper end and a lower end, the upper limb being pivotably connected to the upper end of the handle at a pivot point between the upper and lower ends of the upper limb;

a lower limb having an upper end and a lower end, the lower limb being pivotably connected to the lower end of the handle at a pivot point between the upper and lower ends of the lower limb;

a bowstring strung between the upper end of the upper limb and the lower end of the lower limb, the bowstring being movable between an undrawn position and a fully drawn position;

an upper pulley mounted on the handle and having a helical groove that makes three turns around the upper pulley, the diameter of one of the turns being different from the diameters of the other turns;

a lower pulley mounted on the handle and having a helical groove that makes three turns around the lower pulley, the diameter of one of the turns being different from the diameters of the other turns;

an upper tension cable connected to the upper limb above the pivot point and traveling around the lower pulley and connected to the upper end of the lower limb; and a lower tension cable connected to the lower limb below the pivot point and traveling around the upper pulley and connected to the lower end of the upper limb.

2. A compound archery bow assembly as recited in claim 1, wherein the upper and lower limbs are recurved.

3. A compound archery bow assembly as recited in claim 1, wherein the upper and lower pulleys are sized so that the upper and lower pulleys rotate 360 degrees as the bowstring is drawn from the undrawn position to the fully drawn position.

4. A compound bow assembly as recited in claim 1, wherein the upper tension cable is attached to the lower pulley and the lower tension is attached to the upper pulley.

5. A compound archery bow assembly, comprising:

a handle;

an upper limb having an upper end and a lower end, the upper limb being connected to the handle ;

a lower limb having an upper end and a lower end, wherein the lower limb is connected to the handle;

an upper pulley mounted on the upper end of the upper limb and having a helical groove that makes three turns around the upper pulley, the first and third turns being generally circular and having the same diameter, and the second turn being generally elliptical, the long axis of the second turn being longer than the diameters of the first and third turns;

a lower pulley mounted on the lower end of the lower limb and having a helical groove that makes three turns around the lower pulley, the first and third turns being generally circular and having the same diameter, and the second turn being generally elliptical, the long axis of the second turn being larger than the diameters of the first and third turns;

a bowstring strung between the upper pulley and the lower pulley;

an upper tension cable connected to the upper limb and traveling around the lower pulley and attached to the lower end of the bowstring; and a lower tension cable connected to the lower limb and traveling around the upper pulley and attached to the upper end of the bowstring.

6. A compound bow assembly as recited in claim 5, wherein the upper and lower pulleys are sized so that the upper and lower pulleys rotate 360 degrees as the bowstring is drawn from the undrawn position to the fully drawn position.

7. A compound bow assembly as recited in claim 5, wherein the upper tension cable is attached to the lower pulley and the lower tension cable is attached to the upper pulley.

8. A compound archery bow assembly, comprising:

a handle having an upper end and a lower end;

an upper limb, having an upper end and a lower end, connected to the upper end of the handle at a pivot point between the upper and lower ends of the upper limb;

a lower limb, having an upper end and a lower end, connected to the lower end of the handle at a pivot point between the upper and lower ends of the lower limb;

a bowstring connected between the upper end of the upper limb and the lower end of the lower limb, the bowstring being movable between an undrawn position and a fully drawn position;

an upper pulley mounted on the handle and having a helical groove that makes three turns around the upper pulley, the diameter of the third turn being shorter than the diameters of the other turns;

a lower pulley mounted on the handle and having a helical groove that makes three turns around the lower pulley, the diameter of the third turn being shorter than the diameters of the other turns;

an upper tension cable extending from the upper end of the upper limb around the lower pulley and to the upper end of the lower limb, the upper tension cable being located in the second and third turns of the lower pulley when the bowstring is in the undrawn position, and the upper tension cable being located in the first and second turns of the lower pulley when the bowstring is in the fully drawn position; and a lower tension cable extending from the lower end of the lower limb around the upper pulley and to the lower end of the upper limb, the lower tension cable being located in the second and third turns of the upper pulley when the bowstring is in the undrawn position, and the lower tension cable being located in the first and second turns of the upper pulley when the bowstring is in the fully drawn position.

* * * * *